US007677827B1

(12) United States Patent
Manukian

(10) Patent No.: US 7,677,827 B1
(45) Date of Patent: Mar. 16, 2010

(54) TOOTHBRUSH WITH TOOTHPASTE DISPENSER

(76) Inventor: Oleg Manukian, 36 Mitchell Ave., East Brunswick, NJ (US) 08816

( * ) Notice: Subject to any disclaimer, the term of this patent is extended or adjusted under 35 U.S.C. 154(b) by 0 days.

(21) Appl. No.: 12/286,269

(22) Filed: Sep. 29, 2008

(51) Int. Cl.
*B43M 11/06* (2006.01)

(52) U.S. Cl. ..... 401/186; 401/183; 401/270

(58) Field of Classification Search ..... 401/183–186, 401/270, 273, 278, 282, 286, 290
See application file for complete search history.

(56) References Cited

U.S. PATENT DOCUMENTS 1,701,030 A * 2/1929 Collins ..... 401/278
4,135,831 A * 1/1979 Reitknecht ..... 401/175
4,615,635 A * 10/1986 Kim ..... 401/270
4,826,341 A 5/1989 Kwak
5,846,010 A 12/1998 Barbalich

* cited by examiner

*Primary Examiner*—David J Walczak
(74) *Attorney, Agent, or Firm*—Daniel Kirshner

(57) ABSTRACT

A toothbrush attached to a tube of toothpaste that includes a dispenser and means for stemming the flow of the toothpaste. The toothbrush has a toothbrush head with bristles and the head further includes a toothpaste-dispensing aperture through which toothpaste is dispensed. Extending back from the head is the toothpaste dispenser which includes a conical toothpaste tube attachment member with the point of the cone adjacent to and connected to the head of the toothbrush. At the tip of the cone is an aperture to dispense toothpaste which communicates with the aperture on the head. Extending back from the conical tube attachment member is an elongated, tapering gripping portion that extends over the toothpaste tube to assist the user in controlling and squeezing the tube. A tube of toothpaste is securely attached to a circular back edge of the toothpaste tube attachment member. A switch is positioned into a switch receiving slot, which switch is utilized to stop the flow of toothpaste out of the toothpaste aperture in the head.

1 Claim, 5 Drawing Sheets

SECTION B-B

SECTION A-A
10
12
14
20
22
24
30
32
34
36
38
40
A
B

TOOTHBRUSH WITH TOOTHPASTE DISPENSER

FIELD OF THE INVENTION

The present invention relates to toothbrushes. More specifically, the present invention is a disposable toothbrush that includes a dispenser for toothpaste from an attached tube of toothpaste.

BACKGROUND OF THE INVENTION

Most people brush their teeth every day and in many instances, several times a day. Typically, a person uses a toothbrush and applies toothpaste thereto by squeezing it from a tube. There are known prior art toothbrushes which include a reservoir for retaining toothpaste and either pump or manual means for dispensing the toothpaste from the reservoir and onto the bristles. Examples of such prior art are U.S. Pat. No. 4,787,765 to Kuo entitled Dentrifice Dispensing Toothbrush (pump means to dispense toothpaste) and U.S. Pat. No. 5,908,257 to Martin entitled Toothpaste Dispensing Toothbrush (piston employed to dispense toothpaste).

One disadvantage of the prior art devices is that the toothpaste must first be dispensed out of the toothpaste tube in which it was purchased, and into the reservoir before the toothpaste may be dispensed onto the bristles. The process of filling an onboard reservoir with toothpaste can be cumbersome and messy. As such, it would be advantageous to provide a toothbrush which dispenses toothpaste which is attached to a tube of toothpaste.

There are other disadvantages of known prior-art toothbrushes. When a person is sick, the present method of dispensing toothpaste from a tube of toothpaste onto a toothbrush furthers the risk that germs or pathogens may be passed from the bristles of the brush back to the family tube of toothpaste, risking the spread of disease to others in the family or others who may utilize the same tube of toothpaste.

Yet another disadvantage of the present toothbrush technology is that two hands are required to dispense toothpaste from a tube onto the toothbrush. In other words, typically, a user holds the toothpaste tube in one hand, while spreading toothpaste onto the prior art toothbrush held in the other hand. This may be a hardship, especially to those who may have limited use of their hands, or only have the use of one hand. As such, the present toothbrush technology may be difficult to employ for disabled persons or wounded veterans of the armed forces.

A further disadvantage of the prior art is that a user may use a toothbrush past the time where it is most effective. It is well known that the effectiveness of the bristles is diminished over time. Yet, a user may not be aware that the toothbrush is beyond its term of peak effectiveness and continue to use the toothbrush even though it is less effective.

Therefore, it is an objective of the present invention to provide a toothbrush that provides an integrated tube of toothpaste with a means to dispense toothpaste onto the bristles. It is an objective of the present invention to provide a device with a toothbrush that is attached to a tube of toothpaste thereby obviating the need and the mess of an onboard toothpaste reservoir. Moreover, it is an objective of the present invention to provide a toothbrush which further includes a switch in the nature of a valve to stem the flow of toothpaste through its dispensing aperture in order to store the toothpaste without leakage. It is another objective of the present invention to provide a toothbrush that is easily utilized with one hand. Another objective of the present invention is to provide a toothbrush that reduces the risk of germ spread from the toothbrush to a community-used tube of toothpaste. It is yet another objective of the present invention to provide a toothbrush that the user throws away along with the empty tube of toothpaste, thereby alleviating the problem of utilizing a toothbrush whose bristles are no longer at the peak of effectiveness.

Other objectives, advantages and novel features, and further scope of applicability of the present invention will be set forth in the detailed description to follow, taken in conjunction with the accompanying drawings, will become apparent to those skilled in the art of custom vehicle fabrication upon examination of the following or may be learned by practice of the invention. The objects and advantages of the invention may be realized and attained by means of the instrumentalities and combinations particularly pointed out in the appended claims.

SUMMARY OF THE INVENTION

The present invention is a toothbrush which is attached to a tube of toothpaste and further includes a dispenser and means for stemming the flow of the toothpaste. The toothbrush has a toothbrush head with bristles and the head further includes a toothpaste-dispensing aperture through which toothpaste is dispensed. Extending back from the head is the toothpaste dispenser which includes a conical toothpaste tube attachment member with the point or tip of the cone adjacent to and connected to the head of the toothbrush. At the tip of the cone is an aperture to dispense toothpaste which communicates with the aperture on the head. Extending back from the conical tube attachment member is an elongated, tapering gripping portion that extends over the toothpaste tube to assist the user in controlling and squeezing the tube. A tube of toothpaste is securely attached to a circular back edge of the toothpaste tube attachment member. A switch receiving slot is located on the top side of the body of the toothbrush, in back of the head and in front of the gripping portion. A switch is positioned into the switch receiving slot, which switch is utilized to stop the flow of toothpaste out of the toothpaste aperture in the head. The switch has a finger button at its rear which may be pushed forward thereby causing the valve at the front of the switch to cover the toothpaste dispensing aperture thereby stemming the flow of toothpaste.

BRIEF DESCRIPTION OF THE DRAWINGS

For a better understanding of the present invention, reference is made to the following description of an exemplary embodiment thereof, considered in conjunction with the accompanying drawings, in which:

FIG. 1 is a front perspective view of the present invention toothbrush with the attached tube of toothpaste;

DETAILED DESCRIPTION OF THE INVENTION

Figure 7:
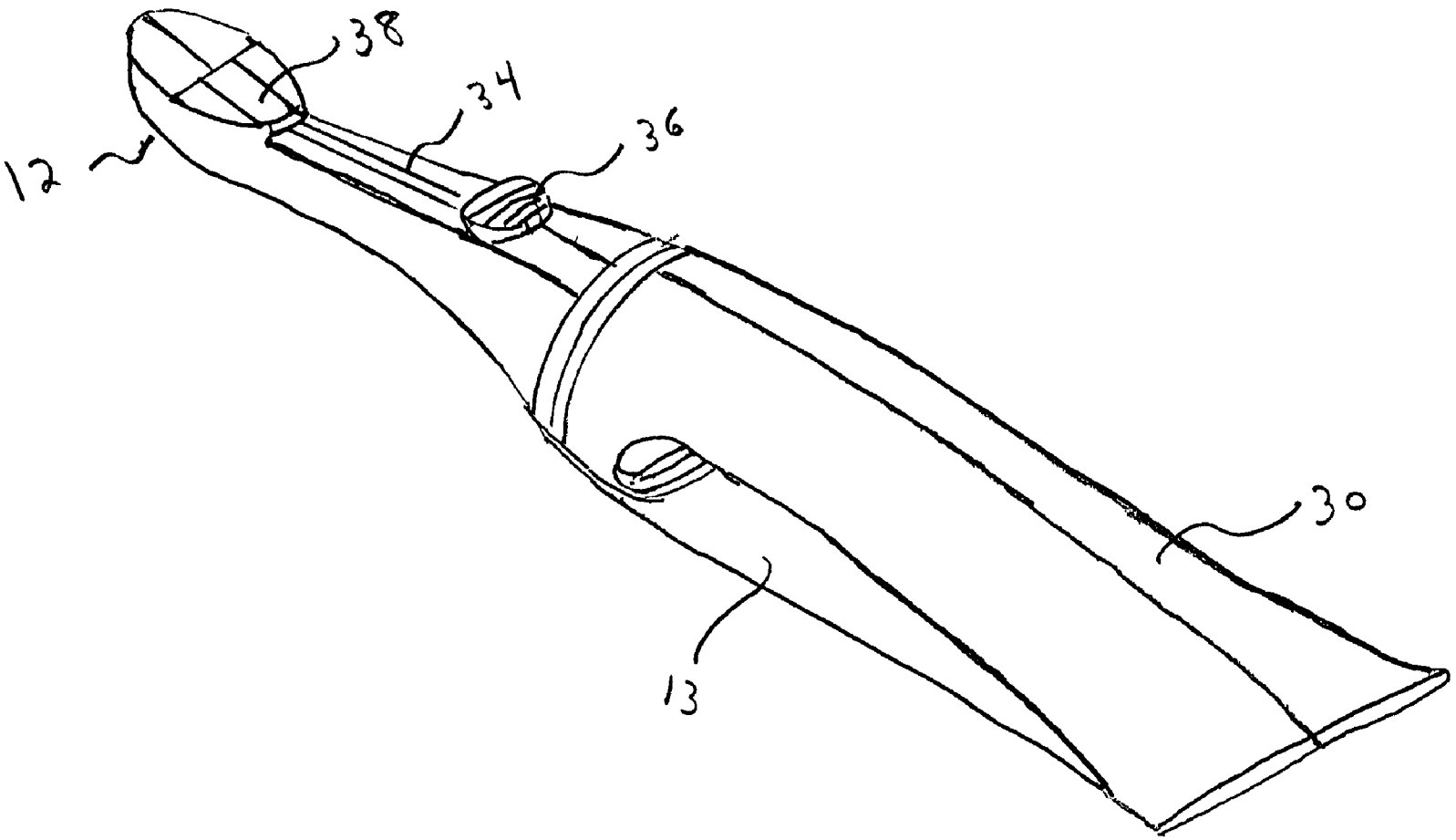
FIG. 7 is a cross-section view thereof; the section taken along line B-B on FIG. 4.
Figure 2:
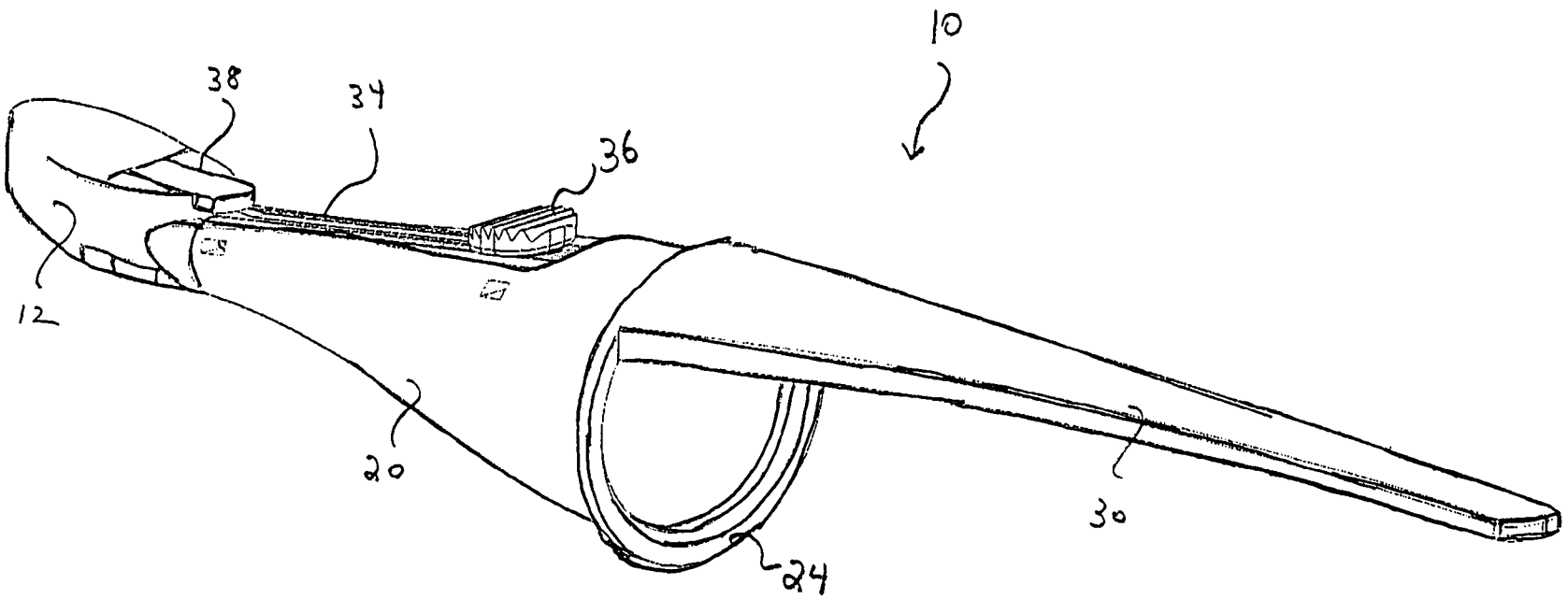
FIG. 2 is a front prospective view of the toothpaste dispenser of the toothbrush.
Figures 3, 4, 5, 6, 7:
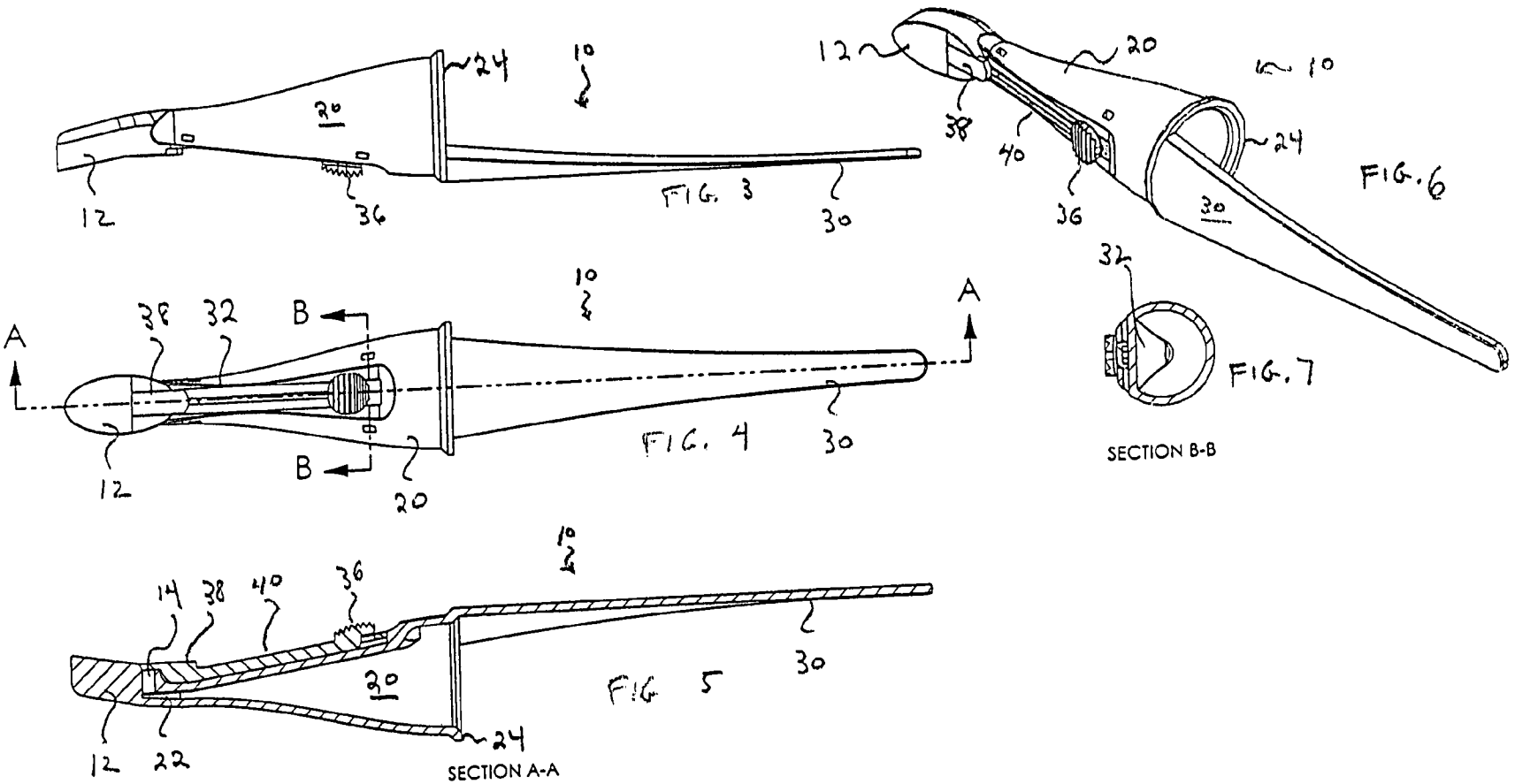
FIG. 3 is a side view thereof.
FIG. 4 is a top view thereof.
FIG. 5 is a cross-sectional view thereof, the section taken along line A-A on FIG. 4.
FIG. 6 is a rear prospective view thereof.

The present invention is a toothbrush with integrated toothpaste tube and toothpaste dispenser. Unlike some prior art toothbrushes that have a reservoir to retain toothpaste, the present invention includes a structure to which is securely attached a typical tube of toothpaste from which the toothpaste is dispensed. Once the toothpaste tube is empty, the entire toothbrush with attached toothpaste tube is disposable. The present invention toothbrush comprises generally the following parts: the toothpaste dispenser 10 which includes a toothpaste tube attachment member 20, an on/off switch 34 to control the flow of toothpaste and a toothpaste tube gripping portion 30, the head of the toothbrush 12 which head includes bristles and a toothpaste dispensing aperture, and a tube of toothpaste 13.

Looking more closely at the Figures, the present invention is a toothbrush molded from plastic or other such rigid material and includes a typical toothbrush head 12 that includes bristles located on the top side of the toothbrush, which bristles are not shown in the drawings, as they are well known in the art. Also molded into the head of the toothbrush is a toothpaste-dispensing aperture 14, through which aperture toothpaste may flow and be dispensed onto the bristles.

Extending back from the head of the toothbrush and formed integrally thereto is the toothpaste dispenser which includes a toothpaste tube attachment member 20. The toothpaste tube attachment member is generally conical in configuration, has a longitudinal axis, and it is sized appropriately to be attached to the tube of toothpaste. At the front of the toothpaste tube attachment member (the front is the portion adjacent to and connected to the head of the toothbrush), at the point (tip) of the cone, is an aperture 22 to permit the flow of toothpaste therethrough which aperture communicates with the corresponding aperture 14 on the toothbrush head. At the rear of the conical toothpaste tube attachment member is an edge 24, which edge is circular for attachment to the top of the tube of toothpaste.

Extending back from the conical toothpaste tube attachment member on the toothpaste dispenser is an elongated toothpaste tube gripping member 30. The gripping member is utilized to stabilize the tube of toothpaste and to assist the user in squeezing the tube in order to dispense toothpaste. The gripping member is attached to the top part of the conical tube attachment member on the toothpaste dispenser, extends back from it, and may taper as it extends back. The gripping member curves downward along its transverse axis, thereby encompassing the curvature of the toothpaste tube, and may also curve down along its longitudinal axis. The length of the gripping member is chosen to coordinate with the tube of toothpaste.

Molded into the top of the toothpaste tube attachment member is a switch-receiving slot 32 as best seen in the cross-sectional views. The slot on the top side of the attachment member is located in back of head of the toothbrush and in front of the elongated toothpaste tube gripping member. The slot is configured to receive the switch 34 and to allow the switch to slide frontward and backward, thereby allowing the user control over the flow of toothpaste.

Figure 8:
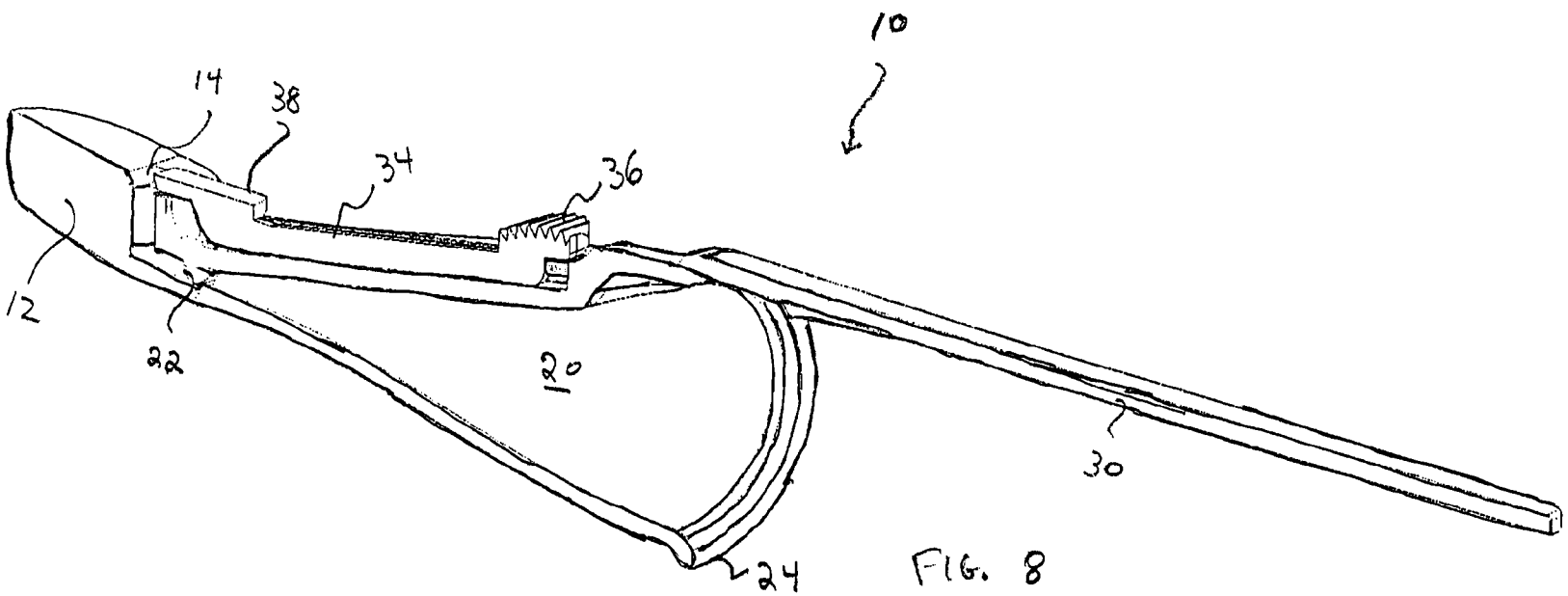
FIG. 8 is a cross-sectional view thereof, showing the switch pushed back into the on position.
Figure 9:
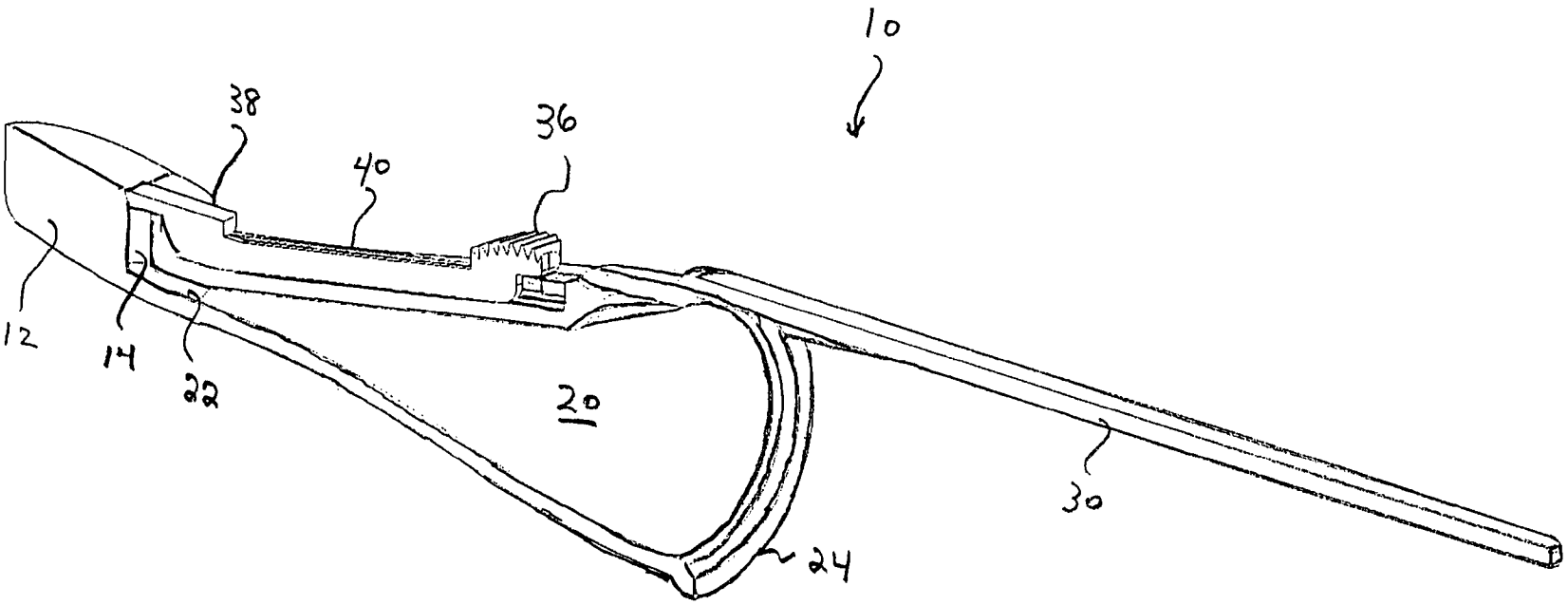
FIG. 9 is a cross-sectional view thereof, showing the switch pushed forward into the off position.

A sliding mechanism in the nature of an on/off switch 34 to control the flow of toothpaste is provided and is positioned into the switch-receiving slot 32 on the body of the toothbrush. The switch, also formed from plastic, is held securely in the slot, but slides readily forward and back. The switch includes a finger button 36 which finger button is ribbed for better tactile response, at the rear end of the switch. At the other end (the front end) of the switch is a valve 38 to stem the flow of toothpaste through the toothpaste aperture on the head. The valve member is in the nature of a flat piece of plastic which covers the toothpaste dispensing aperture 14 on the head thereby preventing toothpaste from flowing. The switch is connected to the valve by an elongating connecting portion 40. When the switch is moved back into to the position closest to the back of the toothbrush, as seen in FIG. 8, the valve is likewise moved back and off of the toothpaste dispensing aperture thereby permitting the flow of toothpaste. Similarly, when the user pushes the button forward as seen in FIG. 9, the valve is now positioned atop of the toothpaste dispensing aperture, thereby stemming the flow of toothpaste.

The tube of toothpaste 13 is connected to the toothpaste tube attachment member 20. Unlike most prior art toothpaste tubes, the toothpaste tube of the present invention does not include a screw top to control the flow of toothpaste exiting the tube. Instead, the tube of toothpaste of the present invention has a substantially circular top edge, which top edge is mated and permanently attached to the circular rear edge 24 of the toothpaste tube attachment member.

The present invention toothbrush is acquired by the user as a unit with the toothpaste tube attached. Generally, the device would be stored with the switch pushed forward, thereby closing the toothpaste aperture, and stemming the flow of toothpaste. When the user desires to brush his or her teeth, the switch is moved back, thereby opening the toothpaste aperture. Now, the user grips the tube of toothpaste along with the gripping portion of the body of the toothbrush in unison, squeezes the tube to dispense toothpaste. The toothpaste flows through the aperture at the tip or point of the conical toothpaste tube attachment member, and thereafter into the aperture in the head. The toothpaste is then dispersed onto the bristles. Upon completion, the switch is now moved forward with the switch receiving slot and into the off position for storage, thereby preventing leakage of toothpaste. Now, the user brushes the teeth in a normal fashion. If desired, the user may brush the teeth on one side of the mouth, reapply toothbrush to the bristles in the above-noted manner, and continue brushing the other side of the mouth. By virtue of the fact that the user directly squeezes the tube of toothpaste, a higher degree of control may be exerted over the flow of toothpaste exiting the tube than is possible with other systems. The present invention toothbrush is utilized until the tube of toothpaste is empty, at which point, the entire device, toothbrush and tube of toothpaste, is thrown away.

The foregoing is considered as illustrative only of the principles and preferred embodiment of the invention. Furthermore, since numerous changes and modifications will readily occur to one skilled in the art, it is not desired to limit the invention to the exact construction, operation and embodiment shown and described, and accordingly all suitable modifications and equivalents may be resorted to, falling within the scope of the invention.

What is claimed:

1. A disposable toothbrush comprising;

a tube of toothpaste;

a toothbrush head having bristles, said toothbrush head having a top side and including a toothpaste dispensing aperture for dispensing toothpaste onto the said bristles, the said bristles extending upward from said top side of the toothbrush head;

a toothpaste dispenser, said toothpaste dispenser including a conical toothpaste tube attachment member having a longitudinal axis, said toothpaste tube attachment member having a rear edge non-removably attached to said tube of toothpaste, said toothpaste tube attachment member having a cone tip at its front portion positioned adjacent to said toothbrush head, said toothpaste tube attachment member including a toothpaste dispensing aperture in its cone tip wherein the aperture in the toothpaste tube attachment member communicates with the toothpaste dispensing aperture on the head, said tube attachment member further including a switch receiving slot aligned along said longitudinal axis of said tube attachment member;

an elongated toothpaste tube gripping portion extending back from a portion of the toothpaste tube attachment member thereby exposing a majority of the tube of toothpaste said toothpaste tube gripping portion tapering as it extends back, thereby facilitating a user's grip on the tube of toothpaste and permitting the user to apply direct pressure to the tube of toothpaste, and a switch to stem the flow of toothpaste through the aperture on the head, said switch positioned within said switch receiving slot, said switch including a finger button and a valve member, said valve member utilized to cover the said toothpaste aperture of said head, the valve member situated flush with said top side of said toothbrush head, whereby a user can push the finger button of the switch forward within the switch receiving slot thereby preventing toothpaste from flowing out of said toothpaste aperture.

* * * * *